United States Patent [19]

Gilliams et al.

[11] 4,331,755

[45] May 25, 1982

[54] TONER COMPOSITION FOR ELECTROSTATIC IMAGE DEVELOPMENT

[75] Inventors: Yvan K. Gilliams, Hever; Pierre R. De Roo, Schoten, both of Belgium

[73] Assignee: Agfa-Gevaert N.V., Mortsel, Belgium

[21] Appl. No.: 221,451

[22] Filed: Dec. 30, 1980

Related U.S. Application Data

[63] Continuation-in-part of Ser. No. 89,385, Oct. 30, 1979, Pat. No. 4,271,249.

[30] Foreign Application Priority Data

Oct. 31, 1978 [GB] United Kingdom ..... 42515/78

[51] Int. Cl.[3] ..... G03G 9/08

[52] U.S. Cl. ..... 430/106; 430/109; 430/110; 430/903

[58] Field of Search ..... 430/106, 107, 109, 110, 430/111, 903

[56] References Cited

U.S. PATENT DOCUMENTS

| | | | |
|---|---|---|---|
| 3,236,776 | 2/1966 | Tomanek et al. | 430/109 |
| 3,925,219 | 12/1975 | Strong | 430/109 |
| 3,985,665 | 10/1976 | Sakaguchi et al. | 430/109 |
| 3,998,747 | 12/1976 | Yamakami et al. | 430/109 X |
| 4,012,363 | 3/1977 | Bruning et al. | 430/109 X |
| 4,140,644 | 2/1979 | Sandhu | 430/109 |

FOREIGN PATENT DOCUMENTS

| | | | |
|---|---|---|---|
| 2338520 | 12/1977 | France | 430/109 |
| 1373220 | 11/1974 | United Kingdom | 430/109 |

*Primary Examiner*—Roland E. Martin, Jr.
*Attorney, Agent, or Firm*—William J. Daniel

[57] ABSTRACT

Electrostatic developer composition and method for developing therewith an electrostatic charge pattern of positive charge wherein the composition is free of carrier particles and consists of powder particles containing at least 80% by weight of a mixture of at least 30% by weight of: a polyester derived from fumaric acid or a mixture of at least 95 mol % fumaric acid and isophthalic acid and a polyol blend of propoxylated bisphenol characterized by the formula:

wherein m and n are integers and added together average from 2 to 7, and at least one of (1) a copolymer of ethylene, maleic acid and/or maleic anhydride wherein from 50 to 70 mol % of ethylene repeating units are present, and (2) a wax of the group consisting of castor wax and montan wax.

6 Claims, 1 Drawing Figure

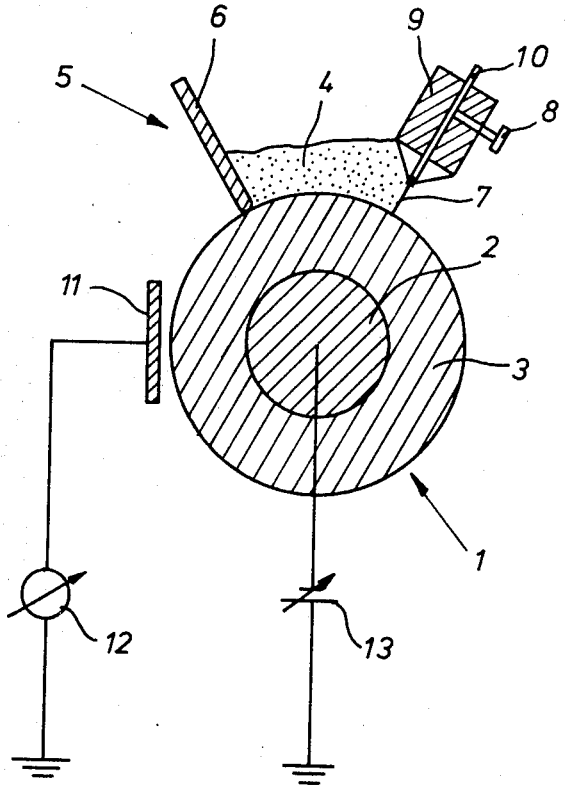
6
9
10
5
4
8
7
2
11
3
1
12
13

TONER COMPOSITION FOR ELECTROSTATIC IMAGE DEVELOPMENT

The present application is a continuation-in-part application of our copending application titled "Composition of matter and method for electrostatic image development" filed on Oct. 30, 1979 and having Ser. No. 89,385, now U.S. Pat. No. 4,271,249 .

The present invention relates to a composition of matter suitable for electrostatic image development of an electrostatic charge pattern of positive charge sign.

Development of an electrostatic charge pattern commonly occurs with toner particles that are attracted by coulomb force to the charge pattern. The toner particles are normally charged by tribo-electricity and in some embodiments obtain an electrostatic charge from a corona discharge. In triboelectric charging the toner has to make contact by friction with another material which in the triboelectric series is sufficiently separated from the toner material. In one very extensively applied technique use is made of a mixture of toner and carrier particles. On a microscopic scale, the sign and magnitude of the toner charge is determined by the triboelectric relationship between the toner and the carrier-particle surface composition. The mechanical agitation occurring in preparing that mixture and during the development process ensures the necessary charging of the toner particles.

Since in carrier-toner particle mixtures the toner is used up, i.e. consumed during development, while the carrier particles remain, a carefully controlled replenishment of toner has to be effected to keep the mixture in proper balance for constant high quality development. The detection of toner exhaustion and the correct rate of replenishment are problems that do not arise when development is carried out with a one-component or monocomponent dry powder toner, which was historically actually the first charge developer to be utilized.

Monocomponent dry toner has been used in so-called transfer or "touchdown development". The term "touchdown development" is generic to development techniques in which a layer consisting of toner particles is brought into close proximity or contact e.g. rolling contact with the surface of the material containing the electrostatic charge pattern to be developed.

The three principal variations practiced in transfer development include (1) an arrangement in which a layer consisting of toner particles supported on a donor surface is held out of contact with the electrostatically imaged material and the toner must traverse an air gap to effect development;

(2) an arrangement in which the toner layer on the donor is brought into rolling contact with the electrostatically imaged material; and (3) an arrangement in which the toner layer is brought into contact with the electrostatically imaged material and skidded or slipped across the imaged surface to effect development.

In the U.S. Pat. No. 3,739,748 by Alfred J. Rittler, Joseph Fantuzzo and Raymond G. Williams, issued June 19, 1973 a typical touchdown development system has been described. In this system a cylindrical or endless applicator or donor member is rotated so that its surface can be presented to the moving surface of a photoconductive drum bearing an electrostatic latent image thereon. Positioned around the periphery of the donor member are a number of processing stations including a toner loading station, at which toner is deposited on the donor member surface; an agglomerate removal station at which multi-particle toner agglomerates are removed from the toner layer retained on the surface of the donor member; a charging station at which a uniform charge is placed on the particles of toner retained on the donor surface; a clean up or leveling station at which the toner layer is converted into one of uniform thickness and at which any toner agglomerates not removed by the agglomerate removing station are removed; a development station at which the toner particles carried by the donor member are presented to the imaged photoconductor for image development; a cleaning station at which a neutralizing charge is placed upon the residual toner particles and a cleaning member which removes residual toner from the peripheral surface of the donor member.

According to the prior art described in U.S. Pat. No. 4,011,834 by Craig H. Stephan, issued Mar. 15, 1977 a variety of donor materials is possible and includes e.g. paper, plastic, cloth, metal, aluminium foil, metal-backed paper, conductive rubber or polyethylene terephthalate.

In published German Patent Application (DE-OS) No. 2,708,299 filed Feb. 25, 1977 by Ricoh Company, Ltd. Tokyo, a touchdown developing apparatus is described in which a corona charging device for charging the toner particles is omitted and replaced by a charging means in the form of a plate or belt. The toner is forced to pass between that plate or belt and a contacting means e.g. a roller or scraper blade, also called doctor blade, and becomes triboelectrically charged. In a described embodiment a polystyrene toner is used in combination with a charging means made of polytetrafluoroethylene and an applicator means in the form of a roller made of rubber e.g. silicone-rubber or chloroprene. The toner acquired thereby a positive charge. By using a charging means made of polyamide (NYLON—registered trade name) the polystyrene toner obtains a negative charge.

It is difficult with charging devices operating by friction to obtain a charge high enough for developing the usual electrostatic charge images. For typical dry toners the average charge is between 5 and 20 $\mu C/g$ of toner (see Comizolli et al.: "Electrophotography"—Proceedings of the IEEE, Vol. 60 no. 4 April (1972) 361.

It has been established experimentally that in defining the average toner charge and the toner charge sign or polarity the composition of the toner is of main importance when a given set of toner applicator and contacting means is used in the touchdown development.

In accordance with the present invention a composition of matter is provided which composition is suited for use as monocomponent toner and which consists of powder particles (also called toner particles) having a Shore A hardness higher than 90 and containing, in addition to a colouring substance, more than 80% by weight a mixture consisting of the following substances (1) and (2) or (1) and (3) or (1), (2) and (3), substance (1) being present in that mixture in a weight ratio of at least 30%, wherein:

(1) is a polyester resin derived from fumaric acid or a mixture of fumaric acid and isophthalic acid wherein the fumaric acid represents at least 95 mole % of the acids, and a polyol blend of propoxylated bisphenol characterized by the formula:

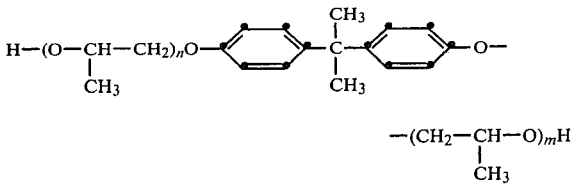

wherein m and n are integers with the proviso that the average sum of m and n is from 2 to 7, the polyester resin being obtained from an amount of acid to polyol so that the number of carboxyl groups to hydroxyl groups is in the ratio of 1.2:1 to 0.8:1.

(2) is a copolymer of ethylene, maleic acid and/or maleic anhydride wherein from 50 to 70 mol % of ethylene repeating units are present, and (3) is a wax of the group consisting of castor wax and montan wax.

Powder particles of this composition can acquire negative charge in the above charging range when used in a touchdown development operating with an applicator means composed of a silicone rubber, a polyurethane or a polyamide including a polyamide crosslinked with an epoxy compound and with a contacting means such as a doctor blade composed of a polyester e.g. polyethylene terephthalate, a polyurethane or a polyamide crosslinked with a compound containing epoxy groups.

For an explanation of Shore A hardness, reference is made to "Indentation Hardness" in Whittington's Dictionary of Plastics by Lloyd R. Whittington—Technomic Publishing Co., Inc. 750 Summer St., Stamford, Conn. 06902, 1st Ed (1968) p. 129.

Further in accordance with the present invention, a touchdown development method for producing a powder image in correspondence with a positive electrostatic charge pattern is provided which comprises the steps of:

(a) imparting a positive electrostatic charge pattern to an electrically insulating medium, (b) providing powder particles composed as defined hereinbefore, (c) frictionally forcing the powder particles through a gap defined by a contacting means e.g. a doctor blade and an applicator means e.g. an applicator roll which carriers on its surface the powder particles passing through the gap in layer form in close proximity or contact with the charge pattern, wherein at least the surface of the applicator means contacting the powder particles is composed of a silicone rubber, a polyurethane, a polyamide resin or a polyamide resin crosslinked with a compound containing epoxy groups and the contacting means at least at its surface contacting the powder particles is composed of a polyester resin e.g. polyethylene terephthalate, a polyurethane or a polyamide resin crosslinked with a compound containing epoxy groups, and (d) delivering the powder particle layer on the applicator means into at least close proximity or contact with the charge pattern to allow at least part of the powder particles thereof to be electrostatically attracted onto the area of the electrically insulating medium carrying the positive charge pattern.

Optionally the toner particles are mixed with a solid lubricating agent (also called free-flowing agent) improving the flowing properties of the toner, in an amount up to 3% by weight with respect to the weight of the toner particles. For example colloidal silica ($SiO_2$) or zinc stearate is mixed with the toner particles in an amount up to 1% by weight. Preferably a mixture of colloidal silica and zinc stearate is used in percentages by weight with respect to the toner particles of about 0.32 to about 0.07 and about 0.14 to about 0.03 respectively.

In the above formula of the propoxylated bisphenol, an average sum of n and m means that in the polyol blend some of the propoxylated bisphenols within the above formula may have more than 7 repeating oxypropylene units but that the average value for the number of oxypropylene units in the polyol blend is from 2 to 7 per bisphenol unit. In a preferred embodiment the propoxylated bisphenol is obtained from 2 to 3 moles of propylene oxide per mole of 2,2-bis(4-hydroxyphenyl)-propane.

The polyol blend used in the preparation of the polyester binder may be prepared by bringing propylene oxide in contact with 2,2-bis(4-hydroxyphenyl)propane also called "Bisphenol A".

The preparation of the above polyester resins and the use of these polyesters in the manufacture of xerographic toners has been described in United Kingdom Patent Specification No. 1,373,220 filed Dec. 2, 1971 by ICI America Inc.

The polyester preparation is preferably performed in an inert atmosphere, e.g. under carbon dioxide, at a moderate temperature and substantially atmospheric pressure during the early stage to reduce loss of the unsaturated acid by volatilization. As the reaction proceeds the temperature may be increased and the pressure reduced. An esterification catalyst may be used although it is generally preferred to carry out the reaction in the absence of excessive amounts of catalyst. A suitable amount of polymerization inhibitor such as hydroquinone or pyrogallol is used to suppress side polymerization through the double bond of the fumaric acid.

The procedure employed to prepare the polyesters useful in this invention generally includes heating to about 200° C. for a period of time sufficient to obtain a desired degree of esterification. The resulting polyester preferably has a low acid number i.e. of not more than 20. The acid number of a resin is determined by measuring the number of milligrams of potassium hydroxide required to neutralize 1 gram of resin. In preparing the polyester, the ratio of carboxyl groups to hydroxyl groups of the starting materials is preferably about 1:1.

A propoxylated bisphenol A fumarate polyester particularly suitable for use according to the present invention is ATLAC 382 E, trade name of Atlas Chemical Industries Inc. (Wilmington, Del., U.S.A.).

This polyester has a glass transition temperature of 55° C. The acid number of said polyester is 13.9. Its intrinsic viscosity [$\eta$] measured at 25° C. in a mixture of phenol/orthodichlorobenzene (60/40 by weight) is 0.175.

The preparation of copolymer (2) proceeds e.g. as has been described in the U.S. Pat. No. 2,396,785 by William E. Hanford, issued Mar. 19, 1946.

A particularly suitable copolymer (2) for use according to the present invention is a copolymer of ethylene, maleic acid and maleic anhydride wherein the amount of acid units is larger than the amount of anhydride units. An example of such copolymer is EMA 22 (EMA is a trade name of Monsanto Chemical Company, St. Louis, U.S.A.) which contains 27.3% by weight of ethylene units, 68.45% by weight of maleic acid units and 3.92% by weight of maleic anhydride units; it has a softening point of 155° C. and decomposition temperature of 250° C; the viscosity of a 2% by weight aqueous solution is 5 mPas and the pH of a 1% by weight aqueous solution is 2.3.

Castorwax is a synthetic, waxlike compound obtained by the controlled hydrogenation of pure selected castor oil. The principal constituent is the glyceride of 12-hydroxystearic acid. The properties of castorwax are described in detail in "Industrial Waxes" by H. Bennett, Chemical Publishing Company, Inc., 212 Fifth Ave., New York, N.Y. (1963), 233–237.

Montan wax is a natural hydrocarbon extracted from lignites and is soluble in chloroform. More details about its production, composition and properties are given in the above book "Industrial Waxes" pages 117–122.

The colouring substance used in the toner particles may be any inorganic pigment (including carbon) or solid organic dyestuff pigment commonly employed in dry electrostatic toner compositions. Thus, use can be made e.g. of carbon black and analogous forms thereof, such as lamp black, channel black, and furnace black e.g. SPEZIAL-SCHWARZ IV (trade-name of Degussa Frankfurt/M, W. Germany) and VULCAN XC 72 (trade name of Cabot Corp., 125 High St., Boston, U.S.A.)

Typical solid organic dyestuffs are so-called pigment dyes, which include phthalocyanine dyes, e.g. copper phthalocyanines, metal-free phthalocyanine, azo dyes, and metal complexes of azo dyes.

The following dyes in pigment form are given for illustration purposes only: FANALROSA B Supra Pulver (trade name of Badische Anilin- & Soda-Fabrik AG, Ludwigshafen, Western Germany, HELIOGEN-BLAU LG (trade name of BASF for a metal-free phthalocyanine blue pigment), MONASTRAL BLUE (a copper phthalocyanine pigment, C.I. 74,160). HELIOGENBLAU B Pulver (trade name of BASF), HELIOECHTBLAU HG (trade name of Bayer AG, Leverkusen, Western Germany, for a copper phthalocyanine C.I. 74,160), BRILLIANT CARMINE 6B (C.I. 18,850), and VIOLET FANAL R (trade name of BASF, C.I. 42,535).

Typical inorganic pigments include black iron(III) oxide and mixed copper(II) oxide/chromium(III) oxide/iron(III)oxide powder, milori blue, ultramarine cobalt blue, and barium permanganate. Further can be mentioned: the pigments described in the French Patent Specifications Nos. 1,394,061 filed Dec. 23, 1963 by Kodak Ltd. and 1,439,323 filed Apr. 27, 1965 by Haris Intertape Corporation.

The characteristics of preferred carbon blacks are listed in the following table 1.

TABLE 1

| | SPEZIALSCHWARZ IV | VULCAN XC 72 |
|---|---|---|
| origin | channel black | furnace black |
| density | 1.8 g × cm$^{-3}$ | 1.8 g × cm$^{-3}$ |
| grain size before entering the toner | 25 nm | 29 nm |
| oil number (g of linseed oil adsorbed by 100 g of pigment) | 300 | 225 |
| specific surface (sq.m per g) | 120 | 190 |
| volatile material (% by weight) | 12 | 2 |
| pH | 3 | 8.5 |
| colour | brown-black | brown-black |

In the preparation of the toner the colouring material is added to the mixture of molten polyester (1) and copolymer (2) and/or wax (3) i.e. castorwax and/or montan wax while stirring until a homogeneous mixture is obtained. After cooling, the solid mass obtained is crushed and ground e.g. in a hammer mill followed by a jet-mill to an average particle size of 1 to 50 microns. Preferably the fraction having a particle size between 10–30 μm is used. The resulting powder is not tacky below 40° C.

The colouring material is normally used in an amount of 5 to 20% by weight calculated on the total weight of toner.

For a given charge density of the charge-carrying surface the maximum development density attainable with toner particles of a given size is determined by the charge/toner particle mass ratio, which is determined substantially by the triboelectric charge obtained by friction contact with the already mentioned applicator means and contacting means.

The FIGURE shows a charging apparatus suitable for touchdown development with toner particles according to the present invention is illustrated. The device is provided with a measuring means for determining the charge applied by friction to the toner particles.

In the illustrated apparatus element 1 represents the toner applicator, the so-called doner, being a cylinder comprising a conductive metal core 2 and a polyamide coating 3 having a thickness of 5 mm. The polyamide elected for that coating is e.g. VERSAMID 950 [trade-name of General Mills Inc. USA for a thermoplastic polyamide prepared from di- and trimerized unsaturated fatty acids (mainly linoleic acid) and polyamines—see Adhäsion Nr. 5 (1957) p. 212]. The toner 4 having e.g. an average particle size of 1–40μ is present in a hopper 5 formed by a grounded metal plate 6 touching the cylinder 1 (applicator roller) and a scraper blade 7, which is made of polyethylene terephthalate. The diameter of the cylinder 1 is 2.5 cm and the thickness of the scraper blade 7 is 0.2 mm. The length of the cylinder 1 which is also the length of the hopper 5 and of the scraper blade 7 is 35 cm. The scraper blade 7 is kept in a holder 10 which is blocked by screws 8 in a frame 9.

The surface of the coating 3 of the applicator roller 1 is preferably not completely smooth and possesses preferably micro cavities with a depth of 10–20 microns in a spatial frequency of an average 20 microns in all directions.

The surface resistivity of coating 3 is preferably in the range of $10^7$ to $10^{10}$ ohms per square and may be controlled by the incorporation of minor amounts (less than 5% by weight) of carbon black. The surface resistivity of the scraper blade 7 is preferably in the range of $10^6$ to $10^{15}$ ohms per square.

Before putting the toner in the hopper the scraper blade 7 is adjusted relative to the cylinder surface to make it just touching. Due to the flexibility of the blade 7 as the cylinder 1 rotates toner particles 4 will be carried along between the scraper blade 7 and the cylinder 1 on the cylinder surface.

The height of the toner mass in the hopper is 2 to 3 cm.

As indicated in the drawing an electrode plate 11 (measuring 4 to 5 cm) is placed in a vertical plane near the cylinder 1 forming a gap width of 1.2 mm with the periphery of the cylinder. The electrode 11 is made of copper and connected to a KEITLY 610 C (trade name) electrometer 12 measuring the charge Q in Coulumb (C) of toner particles deposited in the test onto the electrode 11. The amount of toner 4 deposited during testing on the electrode 11 is measured by weighing and expressed in gram (g). The specific charge obtained on the toner 4 is calculated and expressed in $\mu C/g$.

The core 2 of the cylinder 1 is connected to a variable DC-voltage source 13 which in the circumstances of the present measurement is set at $-1000$ V with respect to ground. The test takes 3 seconds and the pick-up of toner 4 on the electrode 11 was allowed after a preliminary rotation of the applicator roller 1 for 30 seconds. The cylinder 1 rotates at 250 rev/min.

In accordance with the present invention the applicator coating of polyamide resin e.g. VERSAMID 950 (trade name) may be replaced by a coating consisting of polyamide resin crosslinked with a compound containing epoxy groups e.g. VERSAMID 140 [trade name of a polyamide containing 6.66 milliequivalents per gram of free amino ($-NH_2$) groups] crosslinked with a polymer containing free epoxy groups known as EPIKOTE 162 (EPIKOTE is a trade name of Shell Company). The cross-linking reaction is carried out as described hereinafter:

2 parts by weight of a conductive carbon black VULCAN XC 72 (trade name) were dispersed by means of a three roll mill in 69 parts by weight of VERSAMID 140 (trade name). The obtained dispersion was intimately mixed with 29 parts by weight of liquid epoxy resin EPICOTE 162 (trade name) and the mixture was put under reduced pressure for about 5 min to remove the air bubbles.

Thereupon the mixture was poured into an appropriate casting mould (as described in Example 5) and hardened at a temperature of 80° C. in a drying stove.

Other polymers suited for forming the applicator coating are silicone rubbers and polyurethanes e.g. polyurethanes known under the trade name ESTANE (ESTANE is a trade name for polyurethane resins of B. F. Goodrich Chemical Company, Cleveland, Ohio, USA).

The applicator coating has an indentation hardness (known as Shore-A-hardness) that is below 90 Shore A and is preferably substantially smaller than the Shore A hardness of the toner applied thereon e.g. has a Shore A hardness being 30 to 70 Shore A readings smaller or less than the Shore A hardness of the toner.

Instead of being made of polyethylene terephthalate the scraper blade 7 referred to hereinbefore may be made of another polyester resin or of a polyurethane resin or polyamide resin crosslinked with a compound containing epoxy groups. Examples of such polyurethane resins and polyamide resins have been given hereinbefore.

The touchdown development operating with triboelectric charging may be combined with supplementary corona charging but such is not necessary here to obtain the required charging for development. When corona charging is used the corona emission towards the toner is therefore fairly low and may be kept at e.g. 0.15 micro-ampere per inch of corona wire.

Apparatus for carrying out touchdown development and adaptable for use according to the present invention are described in published German Patent Application (DE-OS) No. 2,708,299, mentioned hereinbefore, Belgian Pat. No. 848,236 filed Nov. 10, 1976 by Eskofot Research A/S and European Patent Application No. 78200329.7 filed Dec. 1, 1978 by Agfa-Gevaert N.V.

The fixing of the powder deposited on the charge pattern or transferred on a receptor element e.g. paper sheet may proceed by heat or solvent vapour treatment as is known to those skilled in the art of electrophotography.

The present composition of matter especially when containing in addition to the colouring substance the substances (1) and (3) is particularly suited for use in a fixing technique known as flash fusing which permits fusing the toner image without appreciable heating of the background areas. This is accomplished by selecting a flash lamp with a wavelength range such that radiation is effectively reflected from paper but largely absorbed by the toner image. For more details on the flash fusing fixing technique reference is made to the book "Electrophotography" by R. M. Schaffert, 2nd revised and expanded edition; The Focal Press, London and New York (1975) p. 56–57 to U.S. Pat. No. 3,445,626.

Moreover the present toner is capable of being fixed to a support surface by the application of pressure as described e.g. in the U.S. Pat. No. 3,804,764 by Stephen Strella and Meurig W. Williams, issued Apr. 16, 1974 and United Kingdom Pat. No. 1,210,665 filed Nov. 14, 1967 by Adressograph Multigraph Corporation.

The invention is illustrated by the following examples. All parts, ratios and percentages are by weight unless otherwise indicated.

EXAMPLE 1

70 parts of ATLAC 382 E (trade name) and 20 parts of EMA 22 (trade name) were mixed in a kneader and heated to form a melt. Gradually 10 parts by weight of carbon black (Spezialschwarz IV—trade name) were added and homogeneously mixed with the polymer melt. After about 20 minutes the heating was stopped and while continuing kneading the mixture for forming the toner particles was allowed to cool to room temperature (20° C.). The Shore A hardness of the solidified mixture was 97. That mixture was crushed and milled to form a powder. From the powder obtained the particles with a size between 10 and 30 $\mu m$ were separated.

EXAMPLE 2

Example 1 was repeated with the difference, however, that in the mixture of that Example, 10 parts of ATLAC 382 E (trade name) were replaced by 10 parts of castor wax. The Shore A hardness of the solidified mixture was 94.

EXAMPLE 3

Example 1 was repeated with the difference, however, that in the mixture of that Example, the 20 parts of EMA 22 (trade name) were replaced by 20 parts of castor wax. The Shore A hardness of the solidified mixture was 91.

EXAMPLE 4

Example 1 was repeated with the difference, however, that in the mixture of that Example, 10 parts of ATLAC 382 E (trade name) were replaced by 10 parts of montan wax. The Shore A hardness of the solidified mixture was 96.

EXAMPLE 5

The manufacture of an applicator roller as described in connection with the drawing proceeded by pouring molten VERSAMID 950 (trade name) into a cylindrical casting mould provided with a central steel core. The casting mould was made of polytetrafluorethylene. The air bubbles were removed from the melt by reduced pressure. After solidification and removal from the mould the surface resistivity of the applicator coating was $10^{10}$ ohms per square. By adding 2% by weight of carbon black to the melt a surface resistivity of $10^7$ ohms per square was obtained. The Shore A hardness of the roller surface was 50.

EXAMPLE 6

By the technique described in Example 5 an applicator roller was made from a mixture of VERSAMID 140 (trade name) and epoxy resin EPIKOTE 162 (trade name) in a ratio of 2.37 to 1. Into said mixture being casting 2% of carbon black were incorporated homogeneously on a paint mill. The surface resistivity of the roller was $10^7$ ohms per square. The Shore A hardness of the roller surface was 74.

Other suitable mixtures contained VERSAMID 140 (trade name) and EPIKOTE 162 (trade name) in the ratios 3:1 and 4.15:1, the carbon black content remaining 2%. The Shore A hardness of these mixtures was respectively 63 and 44.

EXAMPLE 7

With the apparatus and process described in connection with the drawing but using an applicator roller manufactured as described in Example 5 and a doctor blade of VERSAMID 140 (trade name) epoxy cured with EPIKOTE 162 (trade name) as described hereinbefore in Example 5 and having a surface resistivity of $10^7$ Ohms per square the toner of Example 1 was charged. The measured toner charge was $-9\ \mu C/g$.

The toner thus charged was used for developing a charge pattern of positive charge sign on a photoconductive selenium layer applied to a conductive drum. In the development the drum was rotatably mounted at the site of the electrode 11 in the charging device of the accompanying drawing.

We claim:

1. A developer composition free of carrier particles and consisting essentially of powder particles having a Shore A hardness higher than 90 and consisting essentially of a colouring substance and more than 80% by weight of a mixture consisting of at least 30% by weight of:

a polyester derived from fumaric acid or a mixture of fumaric acid and isophthalic acid containing at least 95 mol % of fumaric acid and a polyol blend of propoxylated bisphenol characterized by the formula:

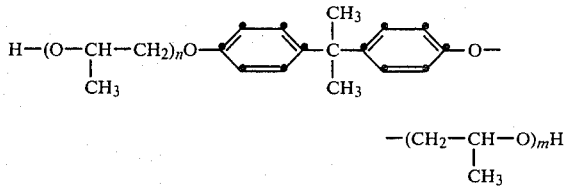

wherein m and n are integers and added together average from 2 to 7, in a proportion such that the ratio of carboxyl groups to hydroxyl groups is 1.2:1 to 0.8:1, with at least one of (1) a copolymer of ethylene, maleic acid and/or maleic anhydride wherein from 50 to 70 mol % of ethylene repeating units are present, and (2) a wax of the group consisting of castor wax and montan wax.

2. A composition of matter according to claim 1, wherein said copolymer is a copolymer of ethylene, maleic acid and maleic anhydride wherein the number of maleic acid units is larger than the number of maleic anhydride units.

3. A composition of matter according to claim 2, wherein the colouring substance is carbon black.

4. A composition matter according to claim 2, wherein said powder particles are mixed with colloidal particles of a solid lubricating agent in an amount of up to 3% by weight with respect to the weight of the powder particles.

5. A composition of matter according to claim 4, wherein the composition contains as lubricating agent silica or zinc stearate or a mixture thereof.

6. A composition of matter according to claim 2, wherein the powder particles have a size in the range of 1 to 40 microns.

* * * * *